US008628906B2

(12) United States Patent
Thaler

(10) Patent No.: US 8,628,906 B2
(45) Date of Patent: Jan. 14, 2014

(54) ADHESIVE PRIMER COATING FOR PRINTING

(75) Inventor: Ofer Thaler, Tel Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1225 days.

(21) Appl. No.: 11/741,632

(22) Filed: Apr. 27, 2007

(65) Prior Publication Data

US 2007/0253751 A1 Nov. 1, 2007

(51) Int. Cl.
*G03G 9/13* (2006.01)

(52) U.S. Cl.
USPC ..... 430/114; 430/45.2

(58) Field of Classification Search
USPC ..... 430/114, 45.2
See application file for complete search history.

(56) References Cited

U.S. PATENT DOCUMENTS

| | | | | |
|---|---|---|---|---|
| 4,684,238 | A * | 8/1987 | Till et al. | 399/308 |
| 5,361,089 | A | 11/1994 | Bearss et al. | |
| 5,744,269 | A * | 4/1998 | Bhattacharya et al. | 430/114 |
| 5,759,733 | A | 6/1998 | Tsubuko et al. | |
| 6,187,498 | B1 * | 2/2001 | Knapp et al. | 430/115 |
| 6,509,128 | B1 | 1/2003 | Everaerts et al. | |
| 7,592,117 | B2 * | 9/2009 | Jackson et al. | 430/117.1 |

FOREIGN PATENT DOCUMENTS

WO WO 03/065126 A1 * 8/2003

OTHER PUBLICATIONS

Webster's II New Riverside University Dictionary, p. 1176, "tacky".*
Notification of Transmittal of The International Search Report and The Written Opinion of the International Searching Authority, or The Declaration. Date of mailing Jun. 14, 2005. 6 pages.
From the International Searching Authority, Written Opinion of the International Searching Authority. 6 pages.

* cited by examiner

*Primary Examiner* — Christopher Rodee

(57) ABSTRACT

A method of printing, comprising:

a) developing a latent image on a photosensitive surface with a visible toner, thereby producing a visible toner image;

b) transferring the visible toner image to a surface of an intermediate transfer member;

c) applying a layer of an adhesive material over at least a portion of the visible toner on the intermediate transfer member, but substantially not to any part of the surface of the intermediate transfer member which is not covered with the visible toner; and d) transferring the visible toner image and the layer of adhesive material from the intermediate transfer member to a printing medium, thereby causing the visible toner to adhere better to the printing medium than it would without the layer of adhesive material, wherein the adhesive material has a stronger adhesion to the printing medium than the visible toner.

4 Claims, 7 Drawing Sheets

ADHESIVE PRIMER COATING FOR PRINTING

RELATED APPLICATIONS

This patent application claims priority to PCT Application No. PCT/IL2004/000989, having PCT Publication No. WO2006/046225, titled "Adhesive Primer Coating for Printing", filed on 28 Oct. 2004, commonly assigned herewith, and hereby incorporated by reference.

FIELD OF THE INVENTION

The field of the invention is printers and copiers.

BACKGROUND OF THE INVENTION

Electrophotographic printers and copiers typically use light to produce a latent image on a photosensitive member by charging certain areas. The latent image is then developed by exposing it to a toner comprising electrically charged toner particles, in the presence of an electrode whose voltage is intermediate between the voltage of the exposed and unexposed areas. Depending on the charge of the toner particles, the toner is only attracted to the exposed areas, or only attracted to the unexposed areas. The toner particles are supplied in a carrier liquid when liquid toner is used.

The developed toner image is typically transferred first to a heated intermediate transfer member, and then transferred from the intermediate transfer member to a printing medium. Although the image can be transferred directly from the photosensitive member to the printing medium, the properties of the photosensitive surface are generally not ideal for printing, and better image quality is obtained by using an intermediate transfer member, with a surface whose properties (particularly temperature) may be optimized for printing.

A desirable property for the intermediate transfer member, and for the toner, is that the toner does not adhere to the intermediate transfer member very well, but that it does adhere well to a range of final printing media, so that all of the toner is transferred to the printing medium. An undesired consequence of avoiding adhesion of the toner to the intermediate transfer member is that the toner often does not adhere very well to the printing medium, especially for non-porous printing media such as plastic sheets.

U.S. Pat. No. 5,361,089, to Bearss et al, the disclosure of which is incorporated herein by reference, describes an electrographic printer which does not use an intermediate transfer member, and which uses a special colorless adhesive toner, in addition to the regular colored toner used to develop the image. The image is first developed on the photosensitive member, using one or more colored toners. Once the complete image is developed on the photosensitive member, the entire surface of the photosensitive member is exposed to light, which can, however, only reach those parts of the surface which are not covered with colored toner. The surface is then developed using the colorless adhesive toner, which has toner particles with a charge opposite to the charge of the toner particles of the colored toner. As a result, the adhesive toner is only attracted to those parts of the surface which are already covered with colored toner. The image, with the adhesive toner coating it, is then printed on the printing medium, and the adhesive toner causes the colored toner to adhere better to the printing medium.

U.S. Pat. No. 6,496,676, to Caruthers et al, the disclosure of which is incorporated herein by reference, describes an electrographic printer which uses an intermediate transfer member. After the toner image is transferred to the intermediate transfer member, the entire surface of the intermediate transfer member, both the areas that are covered with toner and those that are not, is coated with a cohesion increasing solution, which helps the toner image adhere better to the printing medium. The cohesion increasing solution, like the toner, is designed not to stick to the bare surface of the intermediate transfer member when the image is printed. The intermediate transfer member, with the toner image, is also exposed to a corona discharge before printing, which modifies the properties of the toner so that it adheres better to the printing medium.

US patent application 2003/0063922, the disclosure of which is incorporated herein by reference, describes using a powder toner particle coated with additives that improve its adhesion to the printing medium.

It is known to take printing media which do not have good adhesive properties, and to coat them with a special primer, which improves their adhesive properties, before printing.

It is sometimes desirable, for example in printing lottery tickets or prepaid phone cards, to print an image in which a portion of the image does not adhere well to the printing medium, so that it can be scraped off easily, but the rest of the image does adhere well to the printing medium.

SUMMARY OF THE INVENTION

An aspect of an embodiment of the invention concerns a printer in which a toner image is transferred to an intermediate transfer member, and an adhesive material is then applied on top of the image, but only to parts of the image in which the toner covers the surface of the intermediate transfer member. The adhesive does not directly contact the bare surface of the intermediate transfer member, and the adhesive need not have the property that it does not adhere to the intermediate transfer member during printing. After the toner image is printed, the adhesive material, now underlying the toner, causes the toner to adhere better to the printing medium, in those places where the adhesive is present. Because the adhesive need not be designed not to adhere to or damage the surface of the intermediate transfer member, it can be more effective at adhering to different kinds of printing media, as well as to the toner.

Optionally, the adhesive material is itself an electrostatic toner, for example a colorless electrostatic toner, and the pattern of adhesive toner to be applied to the intermediate transfer member is produced by first producing a latent image with that pattern on an imaging surface, for example the surface of a photosensitive member, and then developing the latent image using the adhesive toner instead of a regular toner. The resulting adhesive "image" is then transferred to the intermediate transfer member, on top of the toner image, as if it were another color separation. Optionally, the pattern of the adhesive "image" is calculated by having adhesive only in those pixels where there is toner present in the toner image. Optionally, in the case of a colored image with a plurality of color separations, the adhesive is present only in those pixels where there is at least one color of toner present in the toner image. Optionally the adhesive, like most electrostatic toners, is much less sticky at room temperature than it is at the elevated temperature of the intermediate transfer member, so adhesive toner does not stick to the photosensitive member when the adhesive "image" is transferred from the photosensitive member to the intermediate transfer member.

Optionally, a portion of the toner image on the intermediate transfer member is not coated with the adhesive toner, if it is desired for that portion of the image to be easily scraped off the printing medium after it is printed, for example in printing lottery tickets.

There is thus provided, in accordance with an embodiment of the invention, a method of printing, comprising:

a) developing a latent image on a photosensitive surface with a visible toner, thereby producing a visible toner image;

b) transferring the visible toner image to a surface of an intermediate transfer member;

c) applying a layer of an adhesive material over at least a portion of the visible toner on the intermediate transfer member, but substantially not to any part of the surface of the intermediate transfer member which is not covered with the visible toner; and d) transferring the visible toner image and the layer of adhesive material from the intermediate transfer member to a printing medium, thereby causing the visible toner to adhere better to the printing medium than it would without the layer of adhesive material, wherein the adhesive material has a stronger adhesion to the printing medium than the visible toner.

In an embodiment of the invention applying a layer of an adhesive material comprises:

a) forming a liquid toner comprising toner particles comprising the adhesive material;

b) developing a pattern of the adhesive toner particles on the photosensitive surface corresponding to at least a portion of those areas of the visible toner image where there is visible toner present, but substantially not to those areas of the visible toner image where there is no visible toner present; and c) transferring the pattern of adhesive toner to the surface of the intermediate transfer member, after transferring the visible toner image to the surface of the intermediate transfer member, such that adhesive toner substantially only covers areas of the surface which are covered with visible toner in the visible toner image.

Optionally, the visible toner image comprises a plurality of color separations, and transferring the pattern of adhesive toner to the surface of the intermediate transfer member is done after transferring all of the color separations to the surface of the intermediate transfer member.

Optionally, applying the layer of adhesive toner over at least a portion of the visible toner comprises applying the layer over substantially all of the visible toner.

Optionally, applying the layer of adhesive toner over at least a portion of the visible toner comprises not applying the layer over a second portion of the visible toner, thereby making the second portion of the visible toner more easily removable from the printing medium, after the visible toner image and the layer of adhesive toner are transferred to the printing medium.

There is further provided, in accordance with an embodiment of the invention, an adhesive toner for use in an electrographic printer, the toner comprising adhesive toner particles dispersed in a carrier liquid, the adhesive toner particles comprising.

a) between 15% and 100% by weight of one or more adhesive materials chosen from the group consisting of ethylene vinyl acetate, glycidyl metacrylate, and maleic anhydrid; and b) up to 85% by weight of one or more base polymers suitable for use in toner particles of electrographic liquid toners;

wherein the adhesive toner particles have a greater adhesion to paper or plastic than do toner particles made from the base polymers alone.

Optionally, the one or more base polymers comprise methacrylic acid+ethylene co-polymer.

Optionally, the adhesive materials comprise between 25% and 50% by weight of the adhesive toner particles.

Optionally, the adhesive toner is substantially transparent when printed on a substrate.

There is further provided, in accordance with an embodiment of the invention, a set of toners comprising:

at least one visible toner comprising colored toner particles and carrier liquid having a first adhesion strength to a paper or plastic substrate; and an adhesive toner comprising adhesive toner particles and carrier liquid having a second adhesion greater than the first adhesion to a paper or plastic substrate, wherein the colored and adhesive toner particles comprise polymer materials and wherein the polymer composition of the colored and toner particles is different.

Optionally, the adhesive toner is a toner according to the invention.

There is her provided, in accordance with an embodiment of the invention, an electrographic printer for printing on a printing medium, the printer comprising:

a) an imaging surface;

b) at least one source capable of producing latent images on the imaging surface;

c) at least one reservoir containing a visible electrographic toner capable of developing at least one latent image on the imaging surface to form at least one developed visible image;

d) a reservoir containing an adhesive toner comprising electrically charged adhesive particles, the toner thereby capable of developing a latent image on the imaging surface to form a developed adhesive image;

e) at least one development system that brings the various liquid toners into contact with their respective latent images to develop the images;

f) an intermediate transfer member adapted to receive one or more developed images from the imaging surface and to then transfer the one or more developed images to the printing medium; and g) a controller controlling the pattern of the latent images produced by the at least one source, controlling which toner is used for development of each latent image, and controlling the order of transferring of the developed images to the intermediate transfer member and from the intermediate transfer member to the printing medium, wherein the controller is adapted to control the source and the development system to produce the developed images, such that, when the adhesive image is transferred to the intermediate transfer member after the at least one developed visible images are transferred thereto, and before the at least one visible image is transferred to the printing medium, the pattern of the adhesive image on the intermediate transfer member has adhesive toner substantially only at locations on the intermediate transfer member where there is visible toner.

In an embodiment of the invention, the imaging surface comprises a photosensitive surface, and the source comprises a light source.

In an embodiment of the invention, the controller controls the source and development system such that the pattern of the adhesive image on the intermediate transfer member has adhesive toner substantially at all locations on the intermediate transfer member where there is visible toner in at least one of the visible images.

In an embodiment of the invention, the controller is adapted to control the source and the development system such that, when the adhesive image is transferred to the intermediate transfer member after the at least one developed visible images are transferred thereto, and before the at least one visible image is transferred to the printing medium, the pattern of the adhesive image on the intermediate transfer member does not have adhesive toner on a portion of the at least one developed visible image where there is visible toner, thereby making the visible toner in said portion more easily removable from the printing medium after the developed images are transferred to the printing medium.

Optionally, there are a plurality of reservoirs of visible toner and wherein said at least one visible image comprises a plurality of visible images developed by said plurality of toners, such that a plurality of visible toner images are produced and wherein all of the visible toner images are transferred to the intermediate transfer member before the adhesive image is transferred thereto.

BRIEF DESCRIPTION OF THE DRAWINGS

Exemplary embodiments of the invention are described in the following sections with reference to the drawings. The drawings are generally not to scale and the same or similar reference numbers are used for the same or related features on different drawings.

DETAILED DESCRIPTION OF EXEMPLARY EMBODIMENTS

Figure 1:
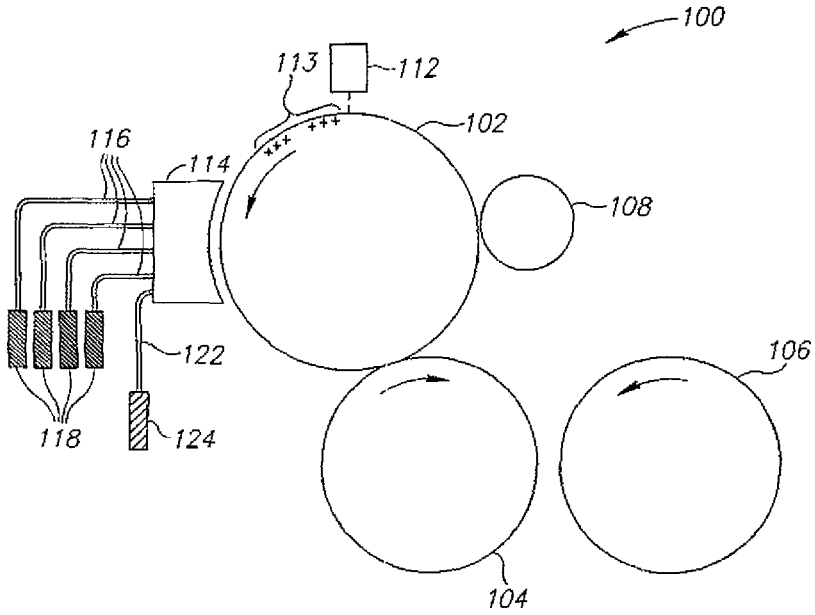
FIGS. 1 through 7 are a time sequence, showing a schematic side cross-sectional view of a printer during a printing process, according to an exemplary embodiment of the invention.

FIG. 1 shows a printer 100, comprising a photosensitive member 102, an intermediate transfer member 104, and an impression cylinder 106, all of them right circular cylinders with axes normal to the plane of the drawing. Optionally there is also a cleaning element 108 for the photosensitive member. A light source 112, for example a laser, has a beam which is modulated in intensity, or turned on and off, as it scans the surface of the photosensitive member along its axis, while the photosensitive member rotates, counterclockwise in the drawing. A corotron or scorotron, not shown, charges the surface of the photosensitive member, before scanning the surface with the beam. The charge on the surface is either positive or negative, depending on the material used for the surface. When the beam is turned on with sufficient power, it discharges the surface locally where it strikes, and when the beam is turned off or has low power, the surface remains charged. Modulating the beam thus produces a latent image 113 on the surface of the rotating photosensitive member, as the beam scans it. Adjacent to the photosensitive member is a developing station 114, comprising one or more electrodes, with tubes 116 connected to visible toner reservoirs 118, and a tube 122 connected to an adhesive toner reservoir 124.

As used herein, "visible toner" refers to a toner which is pigmented or has other characteristics, such as a special texture, which make it visible when printed. Optionally, the visible toner is only visible under certain conditions, for example it may contain fluorescent material and be visible only under appropriate illumination. Examples of visible toner include conventional pigmented liquid toners used in liquid toner printers. The term "visible toner" is used in contrast to "adhesive toner," which is used to describe an adhesive material, formed into charged toner particles and suspended in a toner liquid, used to produce an adhesive "image" underlying the visible toner image on the printing medium, as described below. The terms "visible toner" and "adhesive toner" have been chosen to describe these two types of materials, even though the adhesive toner is optionally visible. Although the term "toner" originally meant a material that imparts a color or "tone" to a printing medium, the adhesive toner need not have any color or tone, and is called a "toner" only because it has electrophoretic properties similar to those of conventional liquid toners used in electrophoretic printers.

Reference to the toner particles in the visible toner as "visible toner particles" does not necessarily mean that the individual particles are visible to the naked eye (they may, for example, be too small to see individually), but only that they are toner particles comprised in the visible toner, as opposed to the toner particles comprised in the adhesive toner. The image formed by the visible toner will be referred to herein as a "visible image," or a "visible toner image," while the "image" formed by the adhesive toner will be referred to as an "adhesive image."

The terms "visible toner" and "adhesive toner", or just "adhesive," are also used herein to describe the material comprising the visible image and the adhesive image respectively, even though most of the toner liquid has been removed from these materials when they form these images.

As shown in FIG. 1, printer 100 is capable of color printing. Optionally, for a printer that does monochrome printing only, there is only one tube 116 and one visible toner reservoir 118.

Figure 2:
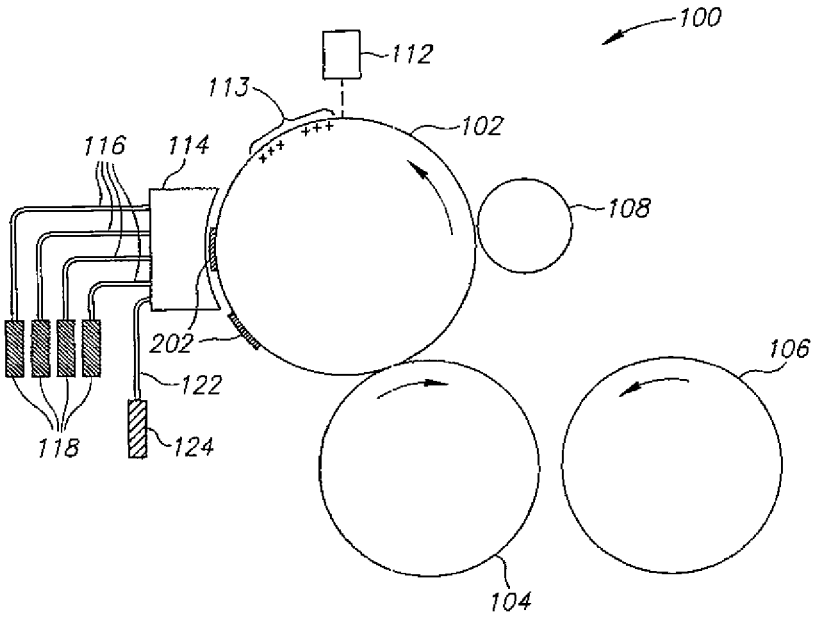

As photosensitive member 102 rotates, portions of latent image 113 are brought successively past developing station 114. As shown in FIG. 2, toner flows through tube 116, and into developing station 114. An electrode in developing station 114 is kept at a voltage intermediate between the voltage of the charged and the uncharged areas of the surface of the photosensitive member. The visible toner contains toner particles which have either positive or negative charge, depending on the type of visible toner used. If the visible toner has negatively charged toner particles, for example, and the surface charge on the photosensitive member is positive, then the visible toner particles are attracted to the charged parts of the photosensitive member which were not exposed to the laser beam, and repelled from the uncharged parts of the photosensitive member which were exposed to the laser beam. As the photosensitive member passes developing station 114, the visible toner develops latent image 113, converting it into a visible image 202. At this time, no adhesive toner flows through tube 122, and no adhesive toner is deposited on the photosensitive member.

Developing station 114 is shown without detail, since its structure is not important to the understanding of the invention. In general, in various embodiments of the invention, the developer may include a charged developer roller spaced from the photosensitive member, into which space toner is admitted to develop the latent image. Alternatively, a developer roller coated with a layer of toner concentrate is used to provide layerwise development of the latent image. Other development methods can be used. In some embodiments of the invention, a charged squeegee roller is used to compress the developed image and remove liquid from it between development and transfer to intermediate transfer member 104.

Figure 3:
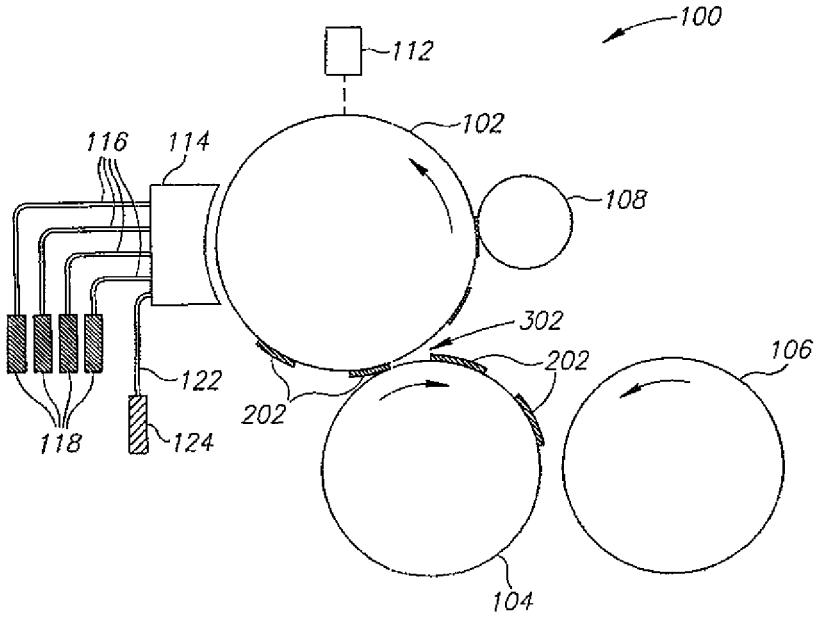

As seen in FIG. 3, visible image 202 passes a nip 302 between photosensitive member 102 and intermediate transfer member 104, whose surface is rotating, clockwise in the drawing, at the same speed as the surface of photosensitive member 102. As it passes nip 302, the visible image is transferred from photosensitive member 102 to intermediate transfer member 104. The transfer is optionally assisted, for example, by applying a voltage to intermediate transfer member 104 which attracts the toner particles to intermediate transfer member 104, and/or by heating intermediate transfer member 104 which causes the visible image to stick to the intermediate transfer member rather than to the photosensitive member. At this time, impression cylinder 106 and cleaning element 110 are not in contact with intermediate transfer member 104, so the visible image is not disturbed as the rotating intermediate transfer member carries the visible image past impression cylinder 106 and cleaning element 110. Any residual visible toner remaining on photosensitive member 102 after passing through nip 302 is removed from the surface of photosensitive member 102 by cleaning element 108, so that the surface of photosensitive member 102 is clean when it again passes the beam of laser 112.

If a colored image is being printed, then, for each color separation, laser 112 is modulated to produce a latent image, which is developed, as it passes developing station 114, using a different color of toner from reservoirs 118. As each image is developed, it is transferred from the surface of photosensitive member 102 to intermediate transfer member 104, just as visible image 202 was transferred. Alternatively, visible images for two or more color separations are developed one on top of the other on the surface of the photosensitive member, and then transferred together to the intermediate transfer member. Alternatively, if a monochrome image is being printed, then there is only one visible image 202. FIGS. 1 through 7 illustrate the case where a monochrome image is printed.

Figure 4:
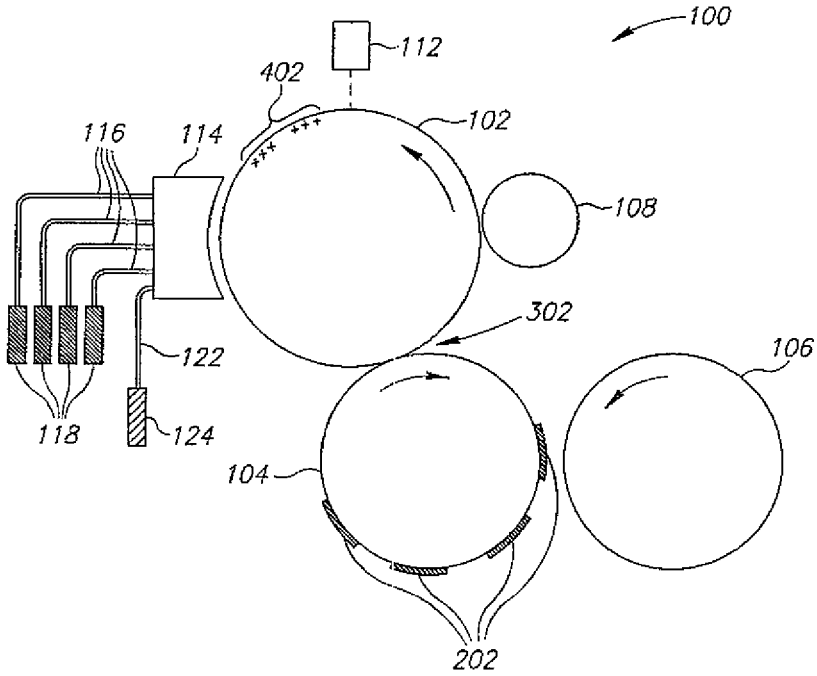
Figure 5:
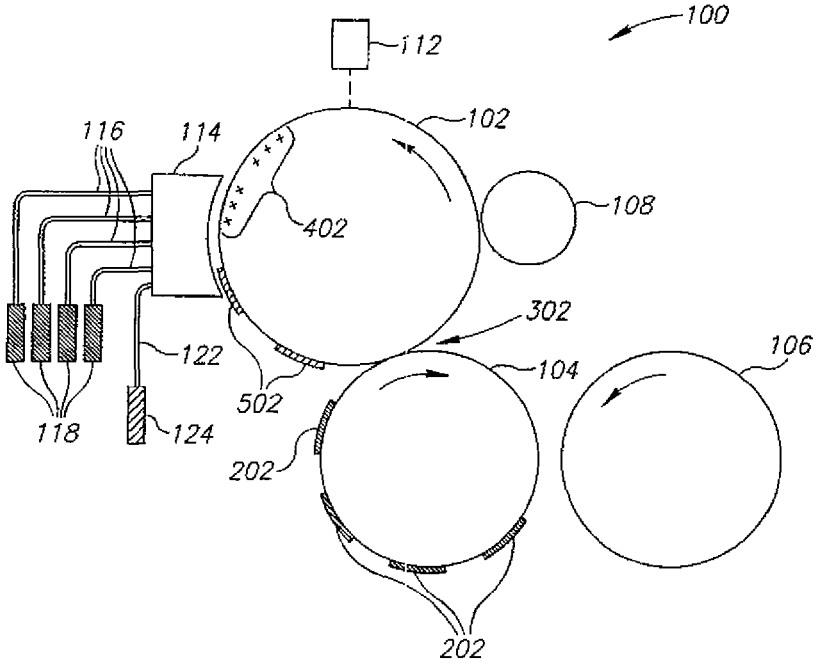

Some time after completing latent image 113, or after completing the last latent image for any of the color separations in the case of color printing, laser 112 is modulated to produce another latent image 402, as seen in FIG. 4. As shown in FIG. 5, latent image 402 is developed as it passes developing station 114, using the adhesive toner in reservoir 124 which passes through tube 122 into developing station 114, instead of using toner from one of reservoirs 118. The adhesive toner in reservoir 124 contains charged toner particles similar to the charged toner particles in the visible toner, (e.g., the colored and adhesive toners are charged with the same charge polarity), but optionally the particles in the adhesive toner do not contain pigment, so that the adhesive toner is colorless or largely colorless. As latent image 402 passes developing station 114, it is converted into an adhesive image 502, in which adhesive is present in the places where the surface of the photosensitive cylinder was not exposed to the laser beam (in the case where the adhesive toner particles have the opposite charge to the surface of the photosensitive member), and is not present in the places which were exposed to the laser beam. Depending on how colorless the adhesive toner is, and on the texture of its surface when it is deposited on the photosensitive image, adhesive image 502 may not be very visible to the human eye.

Figure 6:
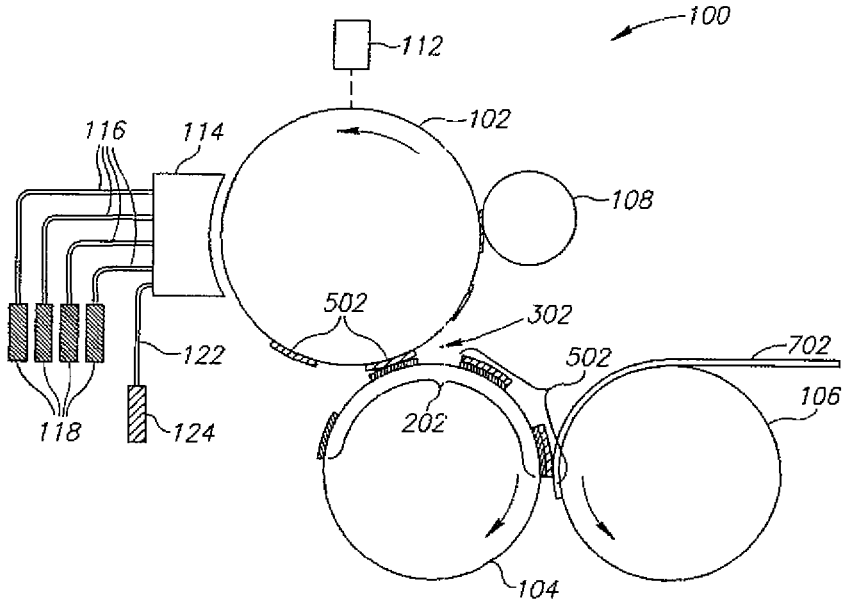

The pattern of adhesive image 502 is optionally identical to the pattern of visible image 202 that was transferred to intermediate transfer member 104, and is positioned on photosensitive member 102 so that, when adhesive image 502 reaches nip 302, it coincides, to a high degree of precision, with visible image 202 on intermediate transfer member 104. As shown in FIG. 6, adhesive image 502, like visible image 202 in FIG. 3, is transferred to intermediate transfer member 104 when it passes nip 302, optionally assisted by a voltage applied to intermediate transfer member 104 which attracts the adhesive toner particles, and/or by heating intermediate transfer member 104 which causes the adhesive to stick to it. Because adhesive image 502 is nearly perfectly aligned with visible image 202, adhesive image 502 ends up on top of visible image 202, with all of the adhesive on top of the visible toner, and none of the adhesive directly deposited on the bare surface of intermediate transfer member 104.

Alternatively, the pattern of adhesive image 502 is not identical to the pattern of visible image 202, but there is at least one region of visible image 202 for which the corresponding region of adhesive image 502 does not have any adhesive. When adhesive image 502 is transferred to intermediate transfer member 104, on top of visible image 202, the visible toner in that region will not have any adhesive on top of it. Later, when the visible image is printed, the visible toner in that region will not adhere to the printing medium as well as the visible toner is other regions which has adhesive underlying it, and the visible toner in that region is more easily scraped off the printing medium, as may be desired for lottery tickets, prepaid phone cards, and other documents with "scratch-off" regions.

Intermediate transfer member 104 is optionally heated. This heating optionally forms the toner image layers into films of toner materials and increases the tackiness of the toner layers. In the case of the adhesive image it may trigger the adhesive nature of the adhesive material (e.g., adhesion based on functional groups present in the adhesive material), which is optionally not tacky at room temperature.

Not having any adhesive directly deposited on the surface of the intermediate transfer member prevents immediate or long-term damage to the intermediate transfer member that could otherwise occur when the adhesive is removed, especially if the intermediate transfer member is heated.

Figure 7:
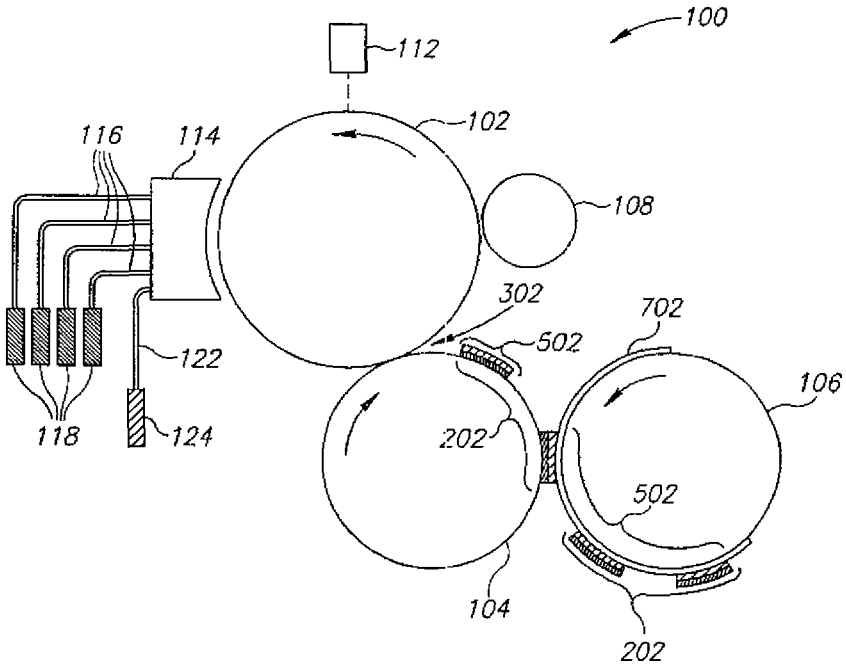

After the adhesive image begins to be transferred to the intermediate transfer member, the visible image, with the adhesive image on top of it, is printed on a printing medium 702, as shown in FIG. 7. Printing medium 702 is wrapped around impression cylinder 106, which rotates in the same direction as photosensitive member 102, counter-clockwise in the drawing. Impression cylinder 106 is preferably pressed against intermediate transfer member 104, so that, when printing medium 702 passes through a nip 704 between intermediate transfer member 104 and impression cylinder 106, visible image 202, together with adhesive image 502, is transferred to printing medium 702 by heat and pressure. Preferably, the surface properties of intermediate transfer member 104, and the properties of the visible toner, are such that nearly all the visible toner (together with the adhesive toner that adheres to the visible toner) is transferred to the printing medium, and little if any toner remains on the intermediate transfer member. Optionally, any residual visible toner remaining on intermediate transfer member 104 after passing through nip 704 is cleaned off intermediate transfer member 104, together with any adhesive toner adhering to the visible toner, a cleaning element (not shown), which is brought into contact with intermediate transfer member 104 at an appropriate time, for example during or shortly after the printing. It should be noted that, when visible image 202 is transferred to the printing medium, adhesive image 502, which had been on top 3 of visible image 202 when they were on the intermediate transfer member, is now between visible image 202 and the printing medium, and helps the visible toner in visible image 202 to adhere better to the printing medium. The adhesive toner is particularly useful when the printing medium is plastic, since the visible toner may not adhere very well to some plastics, but the adhesive toner is optionally used for paper and other printing media as well.

Optionally, aside from any regions that are used to print "scratch-off" documents, adhesive image 502 does not correspond precisely to visible image 202, but each region of adhesive toner is slightly smaller, or even considerably smaller, than the region of visible toner that it rests on top of intermediate transfer member 104, with the adhesive toner not extending all the way to the edge of the visible toner. This has the potential advantage that, if the visible image and the adhesive image are not aligned perfectly, there will still not be any adhesive toner transferred directly to the bare surface of intermediate transfer member 104. Adhesive toner adhering directly to the surface of intermediate transfer member 104 could potentially damage the surface, since the adhesive toner may not be designed to release from the surface of intermediate transfer member 104 during printing. Not designing the adhesive toner to release from the surface of intermediate transfer member 104 has the potential advantage that the adhesive toner can be designed to adhere better to the printing medium.

Optionally, if the adhesive image has areas of adhesive toner that are smaller than the corresponding areas of visible toner in the visible image, then the distance from the edge of a visible toner region to the edge of the corresponding adhesive region is larger than the expected error in alignment between the adhesive image and the visible image. Optionally, this distance is also smaller than the dimensions of any half-tone patterns used in the visible image, which has the potential advantage that the half-tone patterns will have adhesive underlying the visible toner on the printing medium, and will adhere well to the printing medium.

Optionally, making the adhesive areas smaller than the corresponding visible toner areas is not done on a "software level" by using different patterns of pixels, but is accomplished on a "hardware level." It is done, for example, by differences in the laser power when the latent images are produced, by differences in the electrode voltages when the images are developed, and/or by differences in the properties of the adhesive toner and the visible toner, for example different particle size, particle charge, and/or viscosity of the liquid, which lead to differences in the developed images. A potential advantage of producing the difference on the hardware level is that the distance can be smaller than the width of one pixel, and half-tone patterns can be as fine as one pixel in width.

Optionally, instead of having only one photosensitive member, as shown in FIGS. 1-7, there are separate photosensitive members to produce the visible image and the adhesive image. Optionally, in the case of colored printing, there are separate photosensitive members for different colors of toner, to produce the visible toner images for the different color separations.

Optionally, in the case of color printing, all of the color separation visible toner images are transferred to the intermediate transfer member first, and then a single adhesive image is transferred to the intermediate transfer member, with adhesive located only on top of pixels which have at least one color of toner. Alternatively, a separate adhesive image is produced for each color separation, and is transferred to the intermediate transfer member on top of the visible toner image for that color separation. Each color separation visible toner image, with its adhesive image, is printed on the printing medium, before the visible toner image and adhesive image for the next color separation are transferred to the intermediate transfer member. Having a single adhesive image for all the color separations has the potential advantage that fewer adhesive images are produced, saving time and saving adhesive toner.

The composition of the adhesive toner is similar to that of conventional liquid toner, but is made using different resins, which differ from the resins used in conventional liquid toner, in that the molecules contain a higher concentration of functional groups. Alternatively or additionally, the material has a higher tackiness than the toner material. These functional groups cause the polymer chains to be more branched, causing the molecules to be attached more strongly to the surface of the printing medium because of the greater number of free active ends of the polymer chains. The functional groups create chemical bonds (including hydrogen bonds) between the adhesive toner and the printing medium, and between the adhesive toner and the visible toner.

An exemplary composition for the adhesive toner consists of 375 grams of Lotader 8900 and 125 grams of Lotader TX-8030, both made by Atofina, 125 grams of Nucrel 699, made by Dupont, and 1875 grams of Isopar-L, made by Exxon-Mobile. Another exemplary composition consists of 135 grams of Lotader 8900, 153 grams of AC-5120, made by Honeywell, 612 grams of Nucrel 699, and 2100 grams of Isopar-L. Another exemplary composition consists of 138 grams of Lotader 8900, 92 grams of Lotader TX-8030, 134 grams of AC-5120, 536 grams of Nucrel 699, and 2100 grams of Isopar-L. The special adhesive polymers Lotader 8900 and Lotader TX-8030 have many functional groups. Alternatively, other special adhesive polymers are used which have many functional groups. Such alternative adhesive polymers include Lotader 8200 made by Atofina, any of the Primacor products made by Dow, ethylene vinyl acetate, glycidyl metacrylate (GMA), and maleic anhydrid.

The special adhesive polymers, as well as the other polymers that are also used in the visible toner, are chosen to provide the toner, when transferred to the printing medium, with mechanical toughness, including resistance to peeling and to wear from rubbing. They do not cause damage to the surface of the photosensitive member, or to other printer surfaces that they come in contact with, for example a surface of a developer cylinder used for binary image development. Note that they do not come into substantial contact with the intermediate transfer member. The polymers that are also used in the visible toner, such as Nucrel 699 and AC-5120, also do not cause damage to the surface of the intermediate transfer member. The polymers are also optionally chosen so that the toner has low opacity when deposited on the printing medium. This property is potentially advantageous even for the adhesive toner, since the appearance of the visible toner is affected by the color of the underlying printing medium, and will not be changed by the presence of the adhesive toner if the adhesive toner has low opacity.

Alternatively, the quantities of the special adhesive polymer are greater or less than the quantities of Lotader polymers mentioned here, but the special adhesive polymers generally comprise between 15% and 100% of the total solids. Optionally, the special adhesive polymers comprise between 25% and 50% of the total solids, or between 30% and 50% of the total solids. Using more than 50% of the special adhesive polymers can, depending on the materials used, cause the adhesive toner to break into small pieces when it is transferred to the printing medium, and to have worse adhesive properties. For other adhesive materials, the maximum percentage may be larger or smaller than this amount.

When the special adhesive polymers comprise less than some percentage of the total solids, the adhesive properties of the adhesive toner do not differ appreciably from those of the visible toner. For the adhesive materials in the example described above, this lower percentage is about 15% or 20% or 25% or 30%.

In an exemplary method for preparing the adhesive toner, these materials are put in a mixer, such as a Ross planetary mixer, which is heated while stirring at 50 RPM. After the temperature reaches 300° F. (about 149° C.), the mixture is maintained at that temperature and stirred at 60 RPM for at least 30 minutes. The mixture is then allowed to cool down to 150° F. (about 66° C.), over a period of at least half an hour, while the stirring continues. The stirring speed is reduced to 50 RPM, and the mixture is allowed to cool down to room temperature, over a period of approximately two hours or longer. Alternatively, slower or faster stirring speeds are used, but a much slower stirring speed may result in the adhesive toner not having a smooth consistency, and a much higher stirring speed may result in the liquid being separated from the solids by centrifugal force. Temperatures over 300° F. are not used because there is a danger that the mixture will ignite. Cooling the mixture down slowly enough_provides a smooth consistency. 2300 grams of the mixture is placed in an S1 Attritor, with 2% sodium tristearate or aluminum tristearate (as a proportion of the solids content). The mixture is ground at 51° C.±3° C. for at least 90 minutes, and then at 31° C.±3° C. for at least 18 hours.

Other methods such as those used in the art to produce visible liquid toners can be used for producing the adhesive toner. In addition, the base polymer used can be any polymer known for producing liquid toner particles as well as AC-5120 or Nucrel 699 (methacrylate+ethylene copolymer), and the proportions of materials may be varied. In addition, the mix of adhesive materials may be varied.

The invention has been described in the context of the best mode for carrying it out. It should be understood that not all features shown in the drawings or described in the associated text may be present in an actual device, in accordance with some embodiments of the invention. Furthermore, variations on the method and apparatus shown are included within the scope of the invention, which is limited only by the claims. The words "comprise", "include" and their conjugates as used herein mean "include but are not necessarily limited to".

The invention claimed is:

1. A set of toners comprising:

at least one visible toner comprising colored toner particles and carrier liquid having a first adhesion strength to a paper or plastic substrate; and an adhesive toner comprising adhesive toner particles and carrier liquid having a second adhesion greater than the first adhesion to a paper or plastic substrate, the adhesive toner particles comprising:

a) between 30% and 50% by weight of one or more adhesive polymer materials chosen from the group consisting of ethylene vinyl acetate, glycidyl methacrlyate, and maleic anhydride; and b) up to 85% by weight of one or more base polymers suitable for use in toner particles of electro graphic liquid toners, wherein the adhesive toner particles have a greater adhesion to paper or plastic than to toner particles made from the base polymers alone;

wherein the colored and adhesive toner particles comprise polymer materials and wherein the polymer composition of the colored and adhesive toner particles is different;

wherein the colored and adhesive toner particles are charged with a same charge polarity; and wherein the adhesive toner is substantially transparent when printed on the substrate.

2. A set of toners according to claim 1, wherein the one or more base polymers comprise methacrylic acid+ethylene copolymer.

3. A set of toners according to claim 1, wherein the adhesive toner particles have a high concentration of functional groups that the colored toner particles.

4. A set of toners according to claim 3, wherein the functional groups create chemical bonds between the adhesive toner and the paper or plastic substrate and between the adhesive toner and the at least one visible toner.

* * * * *

UNITED STATES PATENT AND TRADEMARK OFFICE

CERTIFICATE OF CORRECTION

PATENT NO. : 8,628,906 B2
APPLICATION NO. : 11/741632
DATED : January 14, 2014
INVENTOR(S) : Ofer Thaler It is certified that error appears in the above-identified patent and that said Letters Patent is hereby corrected as shown below:

In the Claims:

In column 12, line 10, in Claim 1, delete “electro graphic” and insert -- electrographic --, therefor.

In column 12, line 29, in Claim 3, delete “high” and insert -- higher --, therefor.

In column 12, line 30, in Claim 3, delete “that” and insert -- than --, therefor.

Signed and Sealed this
Seventeenth Day of June, 2014

Michelle K. Lee

Michelle K. Lee
*Deputy Director of the United States Patent and Trademark Office*